US011384964B2

(12) United States Patent
Veprik

(10) Patent No.: US 11,384,964 B2
(45) Date of Patent: Jul. 12, 2022

(54) CRYOGENIC STIRLING REFRIGERATOR WITH MECHANICALLY DRIVEN EXPANDER

(71) Applicant: CRYO TECH LTD., Ein Harod (IL)

(72) Inventor: Alexander Veprik, Kiriyat Motzkin (IL)

(73) Assignee: Cryo Tech Ltd., Ein Harod (IL)

( * ) Notice: Subject to any disclaimer, the term of this patent is extended or adjusted under 35 U.S.C. 154(b) by 203 days.

(21) Appl. No.: 16/504,365

(22) Filed: Jul. 8, 2019

(65) Prior Publication Data

US 2021/0010720 A1 Jan. 14, 2021

(51) Int. Cl.
*F25B 9/14* (2006.01)

(52) U.S. Cl.
CPC ..... *F25B 9/14* (2013.01); *F25B 2309/001* (2013.01); *F25B 2309/003* (2013.01); *F25B 2309/1428* (2013.01); *F25B 2321/0022* (2013.01)

(58) Field of Classification Search
CPC ..... F25B 9/14; F25B 2309/001; F25B 2309/003; F25B 2309/1428; F25B 2321/0022
See application file for complete search history.

(56) References Cited

U.S. PATENT DOCUMENTS 3,220,201 A 11/1965 Heuchling et al.
3,991,585 A 11/1976 Mulder et al.
4,664,685 A * 5/1987 Young ..... F02G 1/0435 318/617
5,177,971 A * 1/1993 Kiyota ..... F25B 9/14 60/520
5,195,320 A * 3/1993 Kushnir ..... F02G 1/043 277/350
5,251,883 A * 10/1993 Simon ..... B64C 27/001 188/267
5,345,769 A * 9/1994 Liepert ..... F25B 9/14 60/520
5,345,770 A * 9/1994 Inaguchi ..... F25B 9/14 60/520
6,161,389 A * 12/2000 Sekiya ..... F02G 1/043 62/6
6,209,328 B1 * 4/2001 Kim ..... F04B 35/045 310/13
7,340,918 B1 * 3/2008 Leban ..... F25B 1/02 62/467

(Continued)

FOREIGN PATENT DOCUMENTS

WO WO-2015127324 A1 * 8/2015 ..... F25B 30/00

OTHER PUBLICATIONS

International Search Report for PCT Application No. PCT/IL2020/050757 dated Oct. 4, 2020.

*Primary Examiner* — Brian M King
(74) *Attorney, Agent, or Firm* — Pearl Cohen Zedek Latzer Baratz LLP

(57) ABSTRACT

Integral linear cryogenic Stirling refrigerator comprised of the free piston positive displacement pressure wave generator, the moving assembly of which is connected to the free piston displacer by the dynamic "spring-mass-spring" mechanical phase shifter the mechanical properties of which (spring rates and weight) are selected to provide a predetermined phase lag of motion of the displacer piston relative to the moving assembly of pressure wave generator.

14 Claims, 2 Drawing Sheets

(56) References Cited

U.S. PATENT DOCUMENTS

| | | | | |
|---|---|---|---|---|
| 9,109,533 | B2 | 8/2015 | Budliger et al. | |
| 2005/0223715 | A1* | 10/2005 | Kim | F25B 9/14 62/6 |
| 2006/0042272 | A1* | 3/2006 | Dietz | F25B 9/14 62/6 |
| 2007/0261418 | A1* | 11/2007 | Nun | F25B 9/14 62/6 |
| 2009/0133397 | A1 | 5/2009 | Owens et al. | |
| 2010/0313577 | A1* | 12/2010 | Kirkconnell | F25B 9/14 62/6 |
| 2016/0050490 | A1* | 2/2016 | Bruckman | G05D 19/02 381/97 |
| 2016/0123631 | A1* | 5/2016 | Xu | F25B 9/14 62/6 |
| 2016/0223227 | A1* | 8/2016 | Nakano | F02G 1/053 |
| 2017/0122625 | A1* | 5/2017 | Endo | F25B 9/14 |
| 2017/0343248 | A1* | 11/2017 | Yamada | F25B 9/14 |
| 2019/0207503 | A1* | 7/2019 | Ras | H02K 33/16 |

* cited by examiner

CRYOGENIC STIRLING REFRIGERATOR WITH MECHANICALLY DRIVEN EXPANDER

FIELD OF THE INVENTION

The present invention relates to cryogenic refrigerators. More specifically, the present invention relates to a cryogenic Stirling refrigerator with a mechanically driven expander.

BACKGROUND OF THE INVENTION

Cryogenic refrigeration systems are widely used for providing and maintaining various payloads at stabilized low (cryogenic) temperatures. One application is the cooling of an infrared detector (focal plane array and read-out integrated circuitry) and other related components (cold shield, cold filter, etc.) of a cooled infrared imager, whereupon the desired signal to noise ratio may be achieved typically by decreasing operating temperature of the infrared detector. Therefore, a typical high resolution infrared imager includes a mechanical closed cycle Stirling cryogenic refrigerator (cryogenic cooler).

A typical Stirling cryogenic cooler may include two major components: a pressure wave generator (positive displacement compressor) and an expander (piston displacer). Typically, positive displacement compressor (further—compressor) may be of "moving piston" or "moving cylinder" types. In the "moving piston" concept, the piston reciprocates inside the tightly matched static tubular cylinder liner, and, in the "moving cylinder" concept, the capped tubular cylinder liner reciprocates along the static tightly matched piston. The reciprocating motion of a compression piston or compression cylinder may provide the required pressure pulses and the volumetric reciprocal change of a working agent (helium, typically) in an expansion space of the expander. A displacer, reciprocating inside a cold finger of the expander, shuttles the working agent back and forth from a cold side to a warm side of the cooler through a regenerative heat exchanger. Typically, during an expansion stage of the thermodynamic cycle, the expanding working agent may perform mechanical work on the moving displacer, thus resulting in cooling effect and heat absorption from an IR detector or other cooled component that is mounted to the cold fingertip (cold stage of the cycle). During a compression stage of the thermodynamic cycle, absorbed heat along with the compression heat is rejected to the ambient environment from the base of the cold finger (warm stage of the cycle). The operation of split Stirling cryocooler is detailed in G. Walker. "Cryogenic Coolers, Part 2—Applications", Plenum Press. New York, 1983.

In a split cooler, the compressor and expander may be interconnected by a flexible gas transfer line (e.g., a thin-walled stainless steel tube of small diameter). This arrangement may increase flexibility of the system design and may isolate the cooled component from vibrations that are caused by operation of the compressor. In an integral cooler, all components are enclosed in a common casing. The integral configuration may enable a simpler, compacter, lighter, and less expensive design with better performance (e.g., with lower parasitic pressure losses) than a split configuration.

SUMMARY OF THE INVENTION

There is thus provided, in accordance with some embodiments of the invention, a cryogenic refrigerator device. The cryogenic refrigerator device may include a housing that is configured to enclose a gaseous working agent. The device may also include a compressor, having a moving component configured to be driven back and forth within the housing along a longitudinal axis of the device by a linear electromagnetic actuator. The device may also include a displacer that includes a regenerative heat exchanger and that is configured to slide back and forth along the longitudinal axis within a cold finger that is connected to a distal end of the housing, wherein a proximal end of the displacer is connected to a displacer plunger that includes a bore that enables flow of the working agent between the regenerative heat exchanger and a warm chamber that is proximal to the plunger. The device may also include an auxiliary mass configured to slide back and forth along the longitudinal axis within the housing and between the moving component of the compressor and the displacer plunger. The auxiliary mass may be connected to the moving component of the compressor by a drive spring and to the displacer plunger by a plunger spring, such that motion of the moving component of the compressor is transmitted to the displacer, wherein the auxiliary mass includes a bore to enable the working agent to flow between a compression chamber located between the moving component of the compressor and the auxiliary mass and the warm chamber, and a mass of the auxiliary mass and spring rates of the drive spring and the plunger spring are selected to introduce a predetermined phase shift of motion of the displacer relative to motion of the moving component of the compressor, both of which are driven back and forth periodically.

In some embodiments, the cryogenic refrigerator device may include an electromagnetic driver that is configured to drive the back and forth moving component of the compressor.

In some embodiments, the electromagnetic driver comprises a moving assembly comprising axially and oppositely polarized permanent magnets configured to slide back and forth within the housing along the longitudinal axis, and a coil that is wound about the housing and return iron enclosing the driving coil.

In some embodiments, the compressor comprises a drive piston that is connected to a shaft that extends distally from the magnet assembly.

In some embodiments, the cryogenic refrigerator device may include a clearance seal between the movable compression piston and the static cylinder or between movable compression cylinder and the static piston.

In some embodiments, the compressor comprises a cylinder with a proximal cap, the magnet assembly surrounding and attached to a liner of the cylinder, the cylinder configured to slide back and forth around a cylindrical core that is fixed to the housing.

In some embodiments, the cryogenic refrigerator device may include a clearance seal between the core and the cylinder.

In some embodiments, the oppositely magnetized permanent magnets are separated by a ferromagnetic spacer.

In some embodiments, the cryogenic refrigerator device may include a linear electric motor that is configured to drive the back and forth the moving component of the compressor.

In some embodiments, the predetermined phase shift between motion of the displacer assembly and moving component of the compressor is selected to optimize a coefficient of performance of the device.

In some embodiments, predetermined phase shift between motion of the displacer assembly and moving component of the compressor is in the range of 25° to 35°.

In some embodiments, a phase shift between motion of the auxiliary mass and motion of the moving component of the compressor is in the range of 195° to 205°.

In some embodiments, the cryogenic refrigerator device may include a clearance seal between the plunger and the housing.

In some embodiments, a distal end of the auxiliary mass is mechanically coupled by a plunger spring to a displacer plunger that is connected to the displacer.

In some embodiments, the displacer includes a regenerative heat exchanger or a regenerator.

In some embodiments, the auxiliary mass and the displacer plunger each comprise a central bore so as to allow pneumatic communication of the gaseous working agent between the compression chamber, the warm chamber and a warm side of the regenerator.

BRIEF DESCRIPTION OF THE DRAWINGS

In order for the present invention to be better understood and for its practical applications to be appreciated, the following Figures are provided and referenced hereafter. It should be noted that the Figures are given as examples only and in no way limit the scope of the invention. Like components are denoted by like reference numerals.

DETAILED DESCRIPTION OF THE INVENTION

Figure 1:
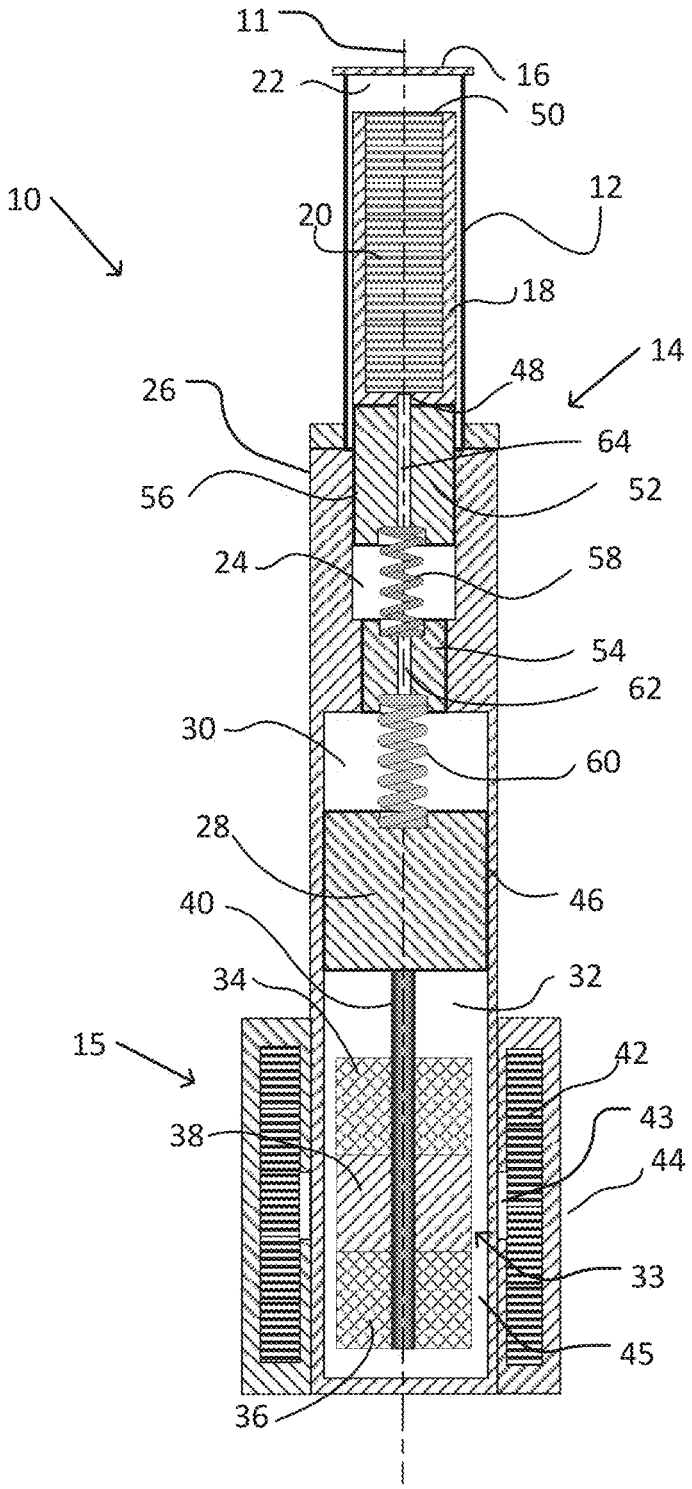
FIG. 1 schematically illustrates an example of an integral linear cryogenic refrigerator with a linearly driven compression piston of a "moving piston" compressor connected to the displacer via a spring-mass-spring mechanical phase shifter.

In the following detailed description, numerous specific details are set forth in order to provide a thorough understanding of the invention. However, it will be understood by those of ordinary skill in the art that the invention may be practiced without these specific details. In other instances, well-known methods, procedures, components, modules, units and/or circuits have not been described in detail so as not to obscure the invention.

Although embodiments of the invention are not limited in this regard, discussions utilizing terms such as, for example, "processing." "computing." "calculating." "determining," "establishing", "analyzing", "checking", or the like, may refer to operation(s) and/or process(es) of a computer, a computing platform, a computing system, or other electronic computing device, that manipulates and/or transforms data represented as physical (e.g., electronic) quantities within the computer's registers and/or memories into other data similarly represented as physical quantities within the computer's registers and/or memories or other information non-transitory storage medium (e.g., a memory) that may store instructions to perform operations and/or processes. Although embodiments of the invention are not limited in this regard, the terms "plurality" and "a plurality" as used herein may include, for example "multiple" or "two or more". The terms "plurality" or "a plurality" may be used throughout the specification to describe two or more components, devices, elements, units, parameters, or the like. Unless explicitly stated, the method embodiments described herein are not constrained to a particular order or sequence. Additionally, some of the described method embodiments or elements thereof can occur or be performed simultaneously, at the same point in time, or concurrently. Unless otherwise indicated, the conjunction "or" as used herein is to be understood as inclusive (any or all of the stated options).

In accordance with an embodiment of the present invention, an integral linear cryogenic refrigerator includes a free piston displacer assembly which is driven mechanically via a chain-wise spring-mass-spring phase shifting mechanism. The mechanism includes a displacer spring that connects between the displacer plunger and an auxiliary mass, and a piston spring that connects between the auxiliary mass and the moving component of the compressor. As used herein, a reciprocating linearly driven element (e.g., "moving piston" or "moving cylinder" that is driven by an electromagnetic linear motor or other reciprocating linear actuator) that is configured to periodically compress and decompress a gaseous working agent in a compression space is referred to as a "compressor". Examples of a compressor include a "moving piston" that is configured to be driven back and forth within a static matched cylinder liner and a capped "moving cylinder" liner that is constructed and configured to be driven back and forth about a matched static piston. Other types of compressors may be used.

Operation of the integral linear cryogenic refrigerator is configured to absorb heat from a cooled component that is in thermal contact with a cold end of the integral linear cryogenic refrigerator, referred to herein as a "cold finger" tip, and to reject heat from a warm side of the integral linear cryogenic refrigerator. Typically, the warm end of the integral linear cryogenic refrigerator is in thermal contact with the ambient atmosphere and is thus at or above the ambient temperature. As used herein, reference to a proximal or distal end of the integral linear cryogenic refrigerator, or of a component of the integral linear cryogenic refrigerator, refers to a position relative to the warm end of the integral linear cryogenic refrigerator.

When the integral linear cryogenic refrigerator is in operation, a moving component of the compressor is moved back and forth along a longitudinal axis of the integral linear cryogenic refrigerator by a linear electric motor within a sealed housing. For example, the linear electric motor may include a linearly moving assembly that includes coaxially arranged axially and oppositely polarized permanent magnet disks sandwiching a circular ferromagnetic yoke. A coaxially arranged stator includes a driving coil that is enclosed by a ferromagnetic back iron material that includes radial and axial air gaps. Alternating current that is applied across the driving coil may apply an alternating axial force to the moving assembly. Other linear electric motor arrangements may be used. For example, in some other arrangements, the stator may include permanent magnets while the linearly moving assembly includes coils (this is typically known as "moving coil" concept).

The compressor may include a close clearance piston/cylinder seal to pneumatically isolate a working agent at a distal (e.g., to the linear electromagnetic motor or to a warm end of the integral linear cryogenic refrigerator) side of the compressor (back space) from gas in a compression space at a proximal end of the drive piston. For example, helium is commonly used as a working agent. Other heavier gasses, such as nitrogen or argon, may also be used.

In some cases, the compressor may be in the form of a compression piston that is arranged to reciprocate inside the tightly matched cylinder and which is connected distally to the linear electric motor.

Alternatively, the compressor may be in the form of a moving capped cylinder liner arranged to slide over a matched static piston. In this example, the walls of the capped cylinder liner may function as the linear guide for the linear electric motor (e.g., includes axially and oppositely polarized annular permanent magnets rings sandwiching an annular ferromagnetic yoke ring, or otherwise).

The compression piston is mechanically coupled to a displacer by a mechanical spring-mass-spring phase shifter. In particular, the proximal end of an auxiliary mass is connected to a displacer spring that is aligned along an axis of a base of the integral linear cryogenic refrigerator. The distal end of the auxiliary mass is mechanically coupled by a displacer spring to a displacer plunger that is connected to a displacer that includes a regenerative heat exchanger, or regenerator.

When the compression piston is driven to move periodically, the coupling via the driving spring results in periodic motion of the auxiliary mass (approximately in opposite phase with the compression piston) and periodic motion of displacer which is phase shifted relative to the compression piston (e.g., phase lag over the range 25° to 40°). This favorable phase shifting may be achieved by an appropriate selection of the weight of the auxiliary mass along with spring rates (spring constants) of the driving and displacer springs.

The regenerator typically includes a porous material having a wet surface, heat capacity and heat conductivity configured to enable free passage of the working agent through the regenerator while cyclically exchanging heat with the working agent.

Each of the auxiliary mass and the displacer plunger include a central bore. The central bores act as conduits to enable pneumatic communication of the working agent between the compression chamber, the warm chamber, and a warm side of the regenerator. Therefore, the working agent in the compression chamber and the warm chamber, and at the warm side of the regenerator, may be approximately at the same temperature and pressure.

An expansion space is formed between a distal end of the displacer and a cold finger plug that seals a distal end of the integral linear cryogenic refrigerator. Typically, the cold finger plug is constructed of, or includes, a thermally conductive material. The cold finger plug may be placed in thermal contact with a component that is to be cryogenically cooled.

The masses of the auxiliary mass and front plunger, as well as the spring rates of the driving and plunger springs, respectively, may be selected so as to form and optimize the Stirling cycle. In the Stirling cycle, although all moving components of the integral linear cryogenic refrigerator (e.g., the compression piston, auxiliary mass, and the combination of displacer plunger and displacer) move cyclically at the same frequency, the phase lag between the motion of compression piston or cylinder and the displacer results in heat pumping from the cold finger cap to the ambient environment.

In particular, the Stirling cycle may be optimized to maximize a coefficient of performance (COP) which is defined as the ratio of heat lift (the rate of heat removal from the cold finger plug to environment) to electrical power input. For example, modeling and optimizing software such as Sage™ (available from Gedeon Associates) may be utilized to optimize the masses and spring rates in accordance with a selected criterion (e.g., minimum power consumption at a given heat lift).

For example, in an example of an integral linear cryogenic refrigerator that is optimized for maximum coefficient of performance, motion of the displacer may lag behind motion of the moving component of the compressor by a phase angle within the range of about 25° to about 35°, depending on the heat lift of the integral linear cryogenic refrigerator. In the same example, the motion of the auxiliary mass may lag behind motion of the moving component of the compressor in the range of about 195° to about 205°.

Since all of the driving forces acting upon the displacer assembly are mechanical, determined primarily by the spring rates and the masses (with some minor contribution by drag forces between moving components and the working agent), operation and efficiency of the integral linear cryogenic refrigerator may be largely independent of pneumatic considerations. Thus, for example, performance, phase lags, and other parameters of operation may be largely independent of the ambient temperature at which heat is rejected to the environment (e.g., over a typical temperature range of about −40 C to about +71 C).

An integral linear cryogenic refrigerator that includes mechanical actuation of the displacer assembly using a mechanical coupling via springs and an auxiliary mass between the compression piston and the displacer assembly may be advantageous over other arrangements. For example, mechanical coupling arrangement may be more efficient with significantly lower parasitic pneumatic and friction losses, than another arrangement relying on pneumatic forces alone. The radially compliant mechanical coupling arrangement may require less precise alignment (e.g., looser tolerances, and thus may be easier, faster, and less expensive to produce) than an arrangement in which the displacer is rigidly connected to a driving rod that extends through one or more tightly matched bores along the length of the linear refrigerator.

FIG. 1 schematically illustrates an example of an integral linear cryogenic refrigerator with a linearly driven compression piston connected to the displacer via a spring-mass-spring mechanical phase shifter.

Integral linear cryogenic refrigerator 10 may be operated to absorb heat into cold plug 16 of a cold finger 12, and to pump and reject heat to the ambient atmosphere via heat conductive walls of refrigerator housing 26. Walls of cold finger 12 and refrigerator housing 26 are sealed so as to enclose and seal a gaseous working agent.

For example, cold plug 16 of the cold finger 12 may be placed in thermal contact with a region, object, or component that is to be cooled, typically to cryogenic temperatures. Walls of cold finger 12 may be made of a thermally nonconductive material (e.g., titanium or stainless steel alloys or another suitable material) and are sufficiently thin so as to minimize parasitic conductive heat inflow from the warm side at refrigerator housing 26 to the cold side at cold tip 16. An example of an object to be cooled is the detector of an infrared imager.

Refrigerator body 14 of integral linear cryogenic refrigerator 10 encloses rear space 32, compression piston 28, compression chamber 30, auxiliary mass 54 and warm chamber 24. During operation of integral linear cryogenic refrigerator 10, heat may be rejected via parts of the heat conductive refrigerator housing 26 that enclose refrigerator body 14.

Integral linear cryogenic refrigerator 10 includes a piston compressor in the form of compression piston 28 which is moved distally and proximally, alternatively and periodically, by linear electromagnetic driver 15. In the example shown, linear electromagnetic driver 15 includes drive shaft 40 that passes through central bores of magnet assembly 33. Compression piston 28 is attached to the distal end of drive shaft 40. One or more clearance seals 46 are provided between compression piston 28 and surrounding refrigerator housing 26 (e.g., a cylinder). Clearance seals 46 pneumatically separate compression chamber 30 from rear space 32.

Magnet assembly 33 includes oppositely polarized permanent rings 34 and 36, each polarized substantially parallel to longitudinal axis 11, that are separated by ferromagnetic yoke 38. Coil 42 is wound around the part of refrigerator housing 26 that surrounds magnet assembly 33 (the windings substantially perpendicular to and surrounding longitudinal axis 11 of motion of compression piston 28). Coil 42 is encased by back iron 44, with axial air gap 43 and radial air gap 45. Back iron 44 may be made of or include a soft ferromagnetic material having high magnetic saturation limit, low iron losses and electrical conductivity (e.g., ST 1008, Hyperco50A, Permandur, or similar materials). An alternating current that flows through coil 42 may generate an alternating magnetic field in parts of back iron 44 and in axial and radial air gaps 43,45. The structure of back iron 44 and of axial and radial air gaps 43,45 may facilitate coupling of an alternating magnetic field with the static magnetic field produced by the permanent magnets 34 and 36 and by ferromagnetic yoke 38. As a result, an alternating force may be applied to the components of the moving assembly that includes magnetic assembly 33 along longitudinal axis 11.

Compression piston 28 is coupled to auxiliary mass 54 by driving spring 60 within compression chamber 30. Auxiliary mass 54 is also configured to slide with minimum friction distally and proximally within refrigerator housing 26. Auxiliary mass 54 is coupled to displacer plunger 52 by displacer spring 58 within warm chamber 24. Displacer plunger 52 is connected to, and is constrained to move together with, displacer 18. The displacer plunger 52 is also configured to slide distally and proximally within refrigerator housing 26, and sliding displacer 18 is also configured to slide distally and proximally within cold finger 12.

Displacer 18 encloses regenerative heat exchanger 20. Porous regenerative heat exchanger 20 is arranged to allow free passage of the working agent and cyclic heat exchange between regenerator material and working agent. For example, regenerative heat exchanger 20 may include random fiber (e.g., made of stainless steel, polyester or another suitable material). The random fiber material may have a small diameter (e.g., a diameter of 4 micrometers in one example). Regenerative heat exchanger 20 has a sufficient heat capacity to store heat that may be absorbed from and released back to the working agent. A cyclic flow of the working agent through regenerative heat exchanger 20 may exert a cyclic drag force on regenerative heat exchanger 20.

An expansion space 22 is formed within cold finger 12 between cold opening 50, at a distal end of displacer 18, and cold finger plug 16. One or more clearance seals 56 that surround displacer plunger 52 may pneumatically separate warm chamber 24 from expansion space 22. Thus, any flow of the working agent between warm chamber 24 and expansion space 22 is constrained to flow via warm opening 48, regenerative heat exchanger 20, and cold opening 50.

Bore 62 within auxiliary mass 54 enables unconstrained pneumatic communication of the gaseous working agent between compression chamber 30 and warm chamber 24. Bore 64 within displacer plunger 52 enables the working agent to flow between warm chamber 24 and warm opening 48 of displacer 18 to the proximal end of regenerative heat exchanger 20. Therefore, the temperatures and pressures of the working agent within compression chamber 30 and warm chamber 24, and at the proximal end of regenerative heat exchanger 20, may be substantially equal.

The weight of auxiliary mass 54, along with the spring rates of drive spring 60 and displacer spring 58 may be selected as to produce favorable phase shifts and strokes of the periodic motions of the displacer assembly (including displacer plunger 52, displacer 18, regenerative heat exchanger 20) relative to the periodic motion of compression piston 28, thus minimizing power consumption at given heat lift.

An alternative arrangement of components of an integral linear cryogenic refrigerator 10 may enable a design that is shorter and wider than the example shown in FIG. 1.

Figure 2:
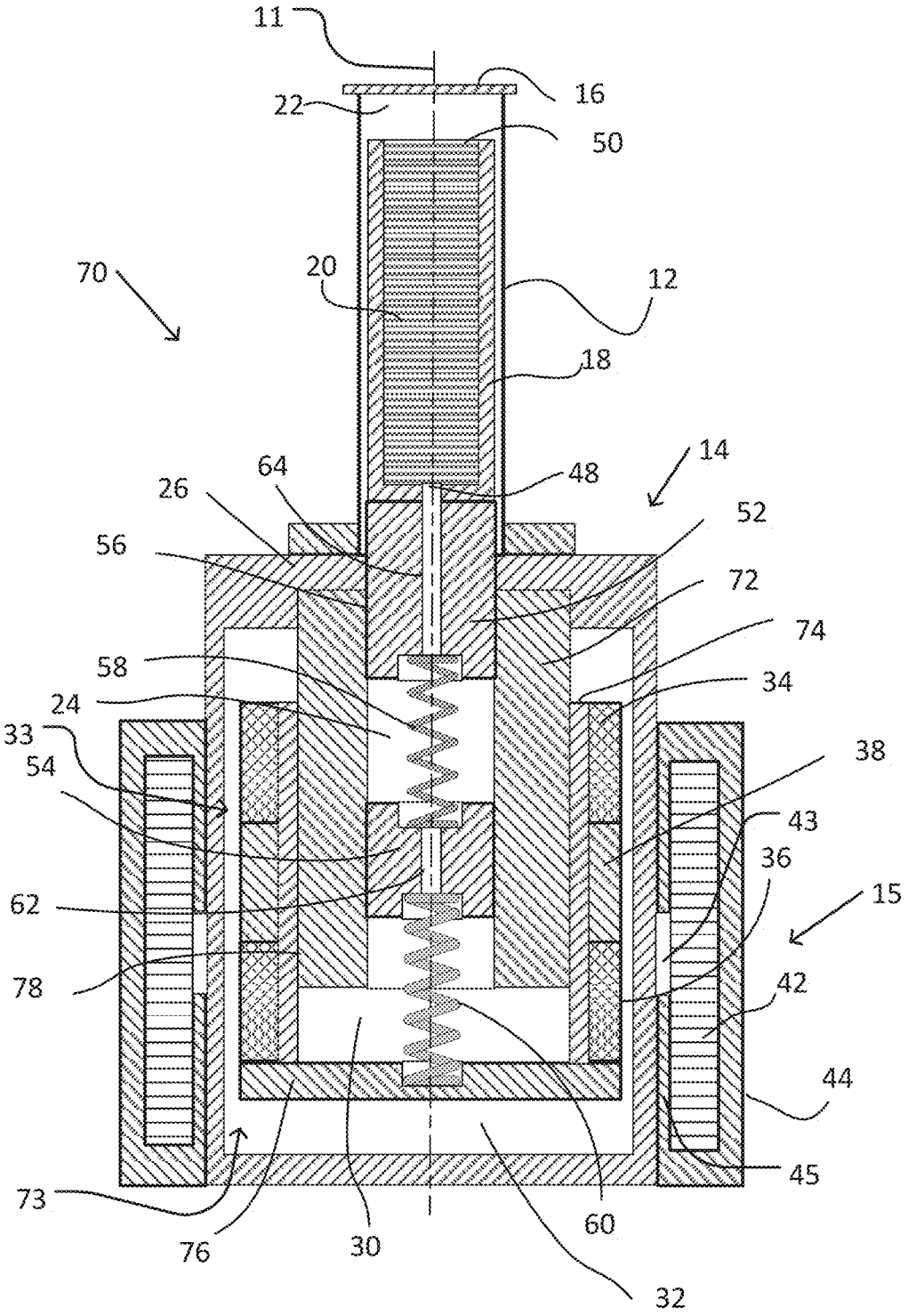
FIG. 2 schematically illustrates an example of an integral linear cryogenic refrigerator with a linearly driven compression cylinder of a "moving cylinder" compressor connected to the displacer via a spring-mass-spring mechanical phase shifting mechanism.

FIG. 2 schematically illustrates an example of an integral linear cryogenic refrigerator with a linearly driven compression cylinder connected to the displacer via a spring-mass-spring mechanical phase shifter.

Integral linear cryogenic refrigerator 70 may be operated to absorb heat at cold finger plug 16 at the distal end of cold finger 12 and to reject heat to the ambient atmosphere via heat conductive walls of refrigerator housing 26.

Refrigerator body 14 of integral linear cryogenic refrigerator 70 encloses rear space 32, a compressor in the form of compression cylinder assembly 73, compression chamber 30, auxiliary mass 54, and warm chamber 24. During operation of integral linear cryogenic refrigerator 70, heat may be rejected to the environment via parts of refrigerator housing 26 that enclose refrigerator body 14. Typically, refrigerator housing 26 includes a heat conductive material for improving heat rejection to environment.

In the example shown, compression cylindrical drive assembly 73 includes a cylinder liner 74 that is configured to slide distally and proximally over the static piston core 72. Piston core 72 is fixed to refrigerator housing 26 of refrigerator body 14. Compression chamber 30 is formed in a space bounded by cylinder cap 76, cylinder liner 74, piston core 72 and auxiliary mass 54.

One or more clearance seals 78 are provided between piston core 72 and cylindrical 74. Clearance seals 78 pneumatically separate compression chamber 30 from rear space 32. Rear space 32 is formed by the space bounded by the outward facing sides of cylinder drive assembly 73, piston core 72, and refrigerator housing 26.

Compression cylinder drive assembly 73 is moved distally and proximally, alternatively and periodically, by linear electromagnetic driver 15. In the example shown, linear electromagnetic driver 15 includes magnet assembly 33 that surrounds, and is attached to so as to move with, cylinder liner 74. As in integral linear cryogenic refrigerator 10 (in FIG. 1), magnet assembly 33 includes oppositely polarized permanent rings 34 and 36, each polarized substantially parallel to longitudinal axis 11, that are separated by ferromagnetic yoke 38. Coil 42 is wound around the pa of refrigerator housing 26 that surrounds magnet assembly 33 and is encased within back iron 44 (that includes a magnetically soft ferromagnetic material, such as ST 1008, Hyperco50A or Permandur) except at axial air gap 43. An alternating current that flows through coil 42 may generate an alternating magnetic field in back iron 44 and in axial air gap 43 and radial air gap 45. The structure of back iron 44 and of axial air gap 43 and radial air gap 45 may facilitate coupling of the alternating magnetic field produced by the driving coil with the static magnetic field produced by oppositely polarized permanent magnets 34 and 36 to alternatingly push magnet assembly 33 in opposite longitudinal direction, together with the cylindrical drive assembly 73.

Compression cylinder drive assembly 73 is coupled to auxiliary mass 54 by driving spring 60 within compression chamber 30.

As described above in connection with integral linear cryogenic refrigerator 10, in integral linear cryogenic refrigerator 70, auxiliary mass 54 is also configured to slide distally and proximally within refrigerator housing 26. Auxiliary mass 54 is coupled to displacer plunger 52 of the displacer assembly, that also includes displacer 18 (e.g., tube) and regenerative heat exchanger 20, by displacer spring 58 within warm chamber 24. The displacer plunger 52 is also configured to slide distally and proximally within refrigerator housing 26, sliding displacer 18 within cold finger 12. Expansion space 22 is formed within cold finger 12 between cold opening 50, at a distal end of displacer 18, and cold finger plug 16. One or more clearance seals 56 that surround displacer plunger 52 may pneumatically isolate warm chamber 24 from expansion space 22. Thus, any flow of the working agent between warm chamber 24 and expansion space 22 is constrained to flow via warm opening 48, regenerative heat exchanger 20, and cold opening 50.

Bore 62 within auxiliary mass 54 enables the working agent to flow freely between compression chamber 30 and warm chamber 24. Bore 64 within displacer plunger 52 enables the working agent to flow between warm chamber 24 and warm opening 48 of displacer 18 to the proximal end of regenerative heat exchanger 20. Therefore, the temperatures and pressures of the working agent within compression chamber 30 and warm chamber 24, and at the proximal end of regenerative heat exchanger 20, may be substantially equal.

Weight of auxiliary mass 54, as well as spring rates of driving spring 60 and displacer spring 58, may be selected as to produce favorable phase shifts and strokes of the periodic motions of the displacer assembly, relative to the periodic motion of compression cylindrical drive assembly 73 (including cylinder cap 76, cylindrical liner 74, magnet rings 34 and 36, and ferromagnetic spacer 38). The optimization procedure may be aimed at minimizing power consumption at a given heat lift. Operation of the Stirling cycle in integral linear cryogenic refrigerator 70 is similar to that of the integral linear cryogenic refrigerator 10. In particular, the results of driven motion of compression cylinder cap 76 of integral linear cryogenic refrigerator 70 are similar to those of the driven motion of compression piston 28 of integral linear cryogenic refrigerator 10.

It may be noted that, in integral linear cryogenic refrigerator 70, magnet assembly 33 is located distally to compression cylinder drive assembly 73 and may surround part or all of one or more of compression chamber 30, auxiliary mass 54, and warm chamber 24. Therefore, the length of integral linear cryogenic refrigerator 70 may be substantially shorter than the length of integral linear cryogenic refrigerator 10, where all the moving parts are located distally to magnet assembly 33. On the other hand, since the diameter of magnet assembly 33 must be sufficiently wide to surround cylindrical liner 74 and the above surrounded parts, the width (e.g., diameter) of integral linear cryogenic refrigerator 70 may be substantially greater than that of integral linear cryogenic refrigerator 10. Accordingly, a decision whether to use a design similar to that of integral linear cryogenic refrigerator 10 or of integral linear cryogenic refrigerator 70 may depend, at least partly, on spatial requirements and constraints. In some cases, differences in relative circumference of coil 42 and magnet assembly 33 may result in different rates of power consumption between a design similar to that of integral linear cryogenic refrigerator 10 and a design similar to that of integral linear cryogenic refrigerator 70.

In both integral linear cryogenic refrigerator 10 and integral linear cryogenic refrigerator 70, there are no net differential pneumatic forces exerted upon the displacer assembly. At a given driving frequency, therefore, the stroke rate and phase lag of displacer assembly are controlled entirely by the combination of masses of the moving components and the spring rates of the driving and displacer springs. The goal of optimization may include minimizing the power consumption at a nominal working point specified by a combination of cold and reject temperatures and a required heat lift, subjected to constraints imposed on the maximum stroke length for movement of auxiliary mass 54.

With integral linear cryogenic refrigerator 10 and integral linear cryogenic refrigerator 70, the phase lag of displacer 18 is independent of reject temperature and other operational conditions. Furthermore, since the lateral stiffness (e.g., along an axis that is perpendicular to longitudinal axis 11) of drive spring 60 and of displacer spring 58 is small, there is no need in precise coaxial alignment of the various components within refrigerator housing 26.

One or more simulation or evaluation procedures, algorithms, or software programs may be applied in order to select the masses and spring constants. For example, one or more commercially available software programs (e.g., Sage™) may be utilized.

The selection of the weight of auxiliary mass 54 enables a favorable phase lag between motion of cylinder cap 76 and displacer 18. Simulations of this design have shown that the coefficient of performance, as well as the dependence of heat lift on relative phases of the motions of each of cylinder cap 76, auxiliary mass 54, displacer plunger 52, are independent of reject temperature (at least within the temperature range of 23 C to 71 C).

The simulations indicate that auxiliary mass 54 moves almost in opposite phase with (e.g., with a phase lag of 195° to about 205° relative to) motion of cylinder cap 76 over heat lift values ranging from about 0.1 W to about 1.2 W. Over the same range of heat lift values, the phase lag of the motion of displacer 18 relative to the motion of cylinder cap 76 varies from about 35° to about 25°.

Different embodiments are disclosed herein. Features of certain embodiments may be combined with features of other embodiments; thus, certain embodiments may be combinations of features of multiple embodiments. The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A cryogenic refrigerator device comprising:

a housing that is configured to enclose a gaseous working agent;

a positive displacement compressor, having a moving component configured to be driven back and forth within the housing along a longitudinal axis of the device by a linear electromagnetic actuator;

a displacer that includes a regenerative heat exchanger and that is configured to slide back and forth along the longitudinal axis within a cold finger that is connected to a distal end of the housing, wherein a proximal end of the displacer is connected to a displacer plunger that includes a bore that enables flow of the working agent between the regenerative heat exchanger and a warm chamber that is proximal to the displacer plunger;

an auxiliary mass configured to slide back and forth along the longitudinal axis within the housing and between the moving component of the compressor and the displacer plunger, a proximal end of the auxiliary mass connected to the moving component of the compressor by a drive spring and a distal end of the auxiliary mass connected to the displacer plunger by a displacer spring such that motion of the moving component of the compressor is transmitted to the displacer solely via drive spring, the auxiliary mass and the displacer spring, wherein the auxiliary mass includes a bore to enable the working agent to flow between a compression chamber located between the moving component of the compressor and the auxiliary mass and the warm chamber, and a mass of the auxiliary mass and spring rates of the drive spring and the plunger spring are selected to introduce a predetermined phase shift of motion of the displacer relative to motion of the moving component of the compressor, both of which are driven back and forth periodically, the predetermined phase shift selected to maximize a coefficient of performance of the device.

2. The device of claim 1, further comprising an electromagnetic driver that is configured to drive the moving component of the compressor back and forth.

3. The device of claim 2, wherein the electromagnetic driver comprises a moving assembly comprising axially and oppositely polarized permanent magnets configured to slide back and forth within the housing along the longitudinal axis, and a coil that is wound about the housing and return iron enclosing the driving coil.

4. The device of claim 3, wherein the compressor comprises a drive piston that is connected to a shaft that extends distally from the magnet assembly.

5. The device of claim 3, wherein the axially and oppositely magnetized permanent magnets are separated by a ferromagnetic spacer.

6. The device of claim 1, wherein the moving component of the compressor is a piston, the device further comprising a clearance seal between the piston and a static cylinder.

7. The device of claim 1, wherein the moving component of the compressor is a cylinder, the device further comprising a clearance seal between the cylinder and a static piston.

8. The device of claim 7, wherein the compressor comprises a cylinder liner with a proximal cap, the magnet assembly surrounding and attached to the cylinder liner, the cylinder configured to slide back and forth around a cylindrical core that is fixed to the housing.

9. The device of claim 8, further comprising a clearance seal between the core and the cylinder liner.

10. The device of claim 1, further comprising a linear electric motor that is configured to drive the moving component of the compressor back and forth.

11. The device of claim 1, wherein the predetermined phase shift is in the range of 25° to 35°.

12. The device of claim 1, wherein a phase shift between motion of the auxiliary mass and motion of the drive piston is in the range of 195° to 205°.

13. The device of claim 1, further comprising a clearance seal between the displacer plunger and the housing.

14. The device of claim 1, wherein the auxiliary mass comprises a central bore so as to allow pneumatic communication of the working agent between the compression chamber, the warm chamber and a warm side of the regenerator.

* * * * *